US006296491B1

(12) United States Patent
Pickles

(10) Patent No.: US 6,296,491 B1
(45) Date of Patent: Oct. 2, 2001

(54) CARD EDGE CONNECTOR INCORPORATING HOT PLUG SWITCH

(75) Inventor: Charles Sands Pickles, York, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/693,414

(22) Filed: Oct. 20, 2000

(51) Int. Cl.[7] ..... H01R 12/00
(52) U.S. Cl. ..... 439/60; 439/637
(58) Field of Search ..... 439/59, 60, 76.1, 439/924.1, 636, 637, 188

(56) References Cited

U.S. PATENT DOCUMENTS 5,024,609 * 6/1991 Piornneck ..... 439/637
5,052,936 * 10/1991 Biechler et al. ..... 439/60
5,800,203 * 9/1998 Pratt et al. ..... 439/637
5,820,392 * 10/1998 Lin et al. ..... 439/108
5,876,214 * 3/1999 McHugh et al. ..... 439/60
5,997,312 * 12/1999 Ho et al. ..... 439/60

* cited by examiner

*Primary Examiner*—Tulsidas Patel
(74) *Attorney, Agent, or Firm*—Wei Te Chung

(57) ABSTRACT

An electrical card edge connector (1) includes an elongated insulative housing (10), a number of juxtaposed electrical engaging terminals (11) mounted in the housing and a pair of electrical hot plug switching modules (2) assembled in the insulative housing. The insulative housing comprises a card receiving slot (16) for receiving an electronic card. The card receiving slot defines a slot bottom face (160). The switching modules each includes a printed circuit board portion (22) and a number of switching terminals (13, 15) retained in the printed circuit board portion. A first distance H1 is defined between contact portions (116) of the engaging terminals 11 and the slot bottom face (160) and a second distance H2 is defined between contact portions (136, 156) of the switching terminals (13, 15) and the slot bottom face (160). The first distance H1 is relatively smaller than the second distance H2.

14 Claims, 5 Drawing Sheets

CARD EDGE CONNECTOR INCORPORATING HOT PLUG SWITCH

BACKGROUND OF THE INVENTION

1. Field of the Invention

The present invention relates to a connector, and particularly to a card edge connector incorporating a hot plug switching mechanism therein.

2. Description of the Related Art

Electronic cards, such as sound cards and graphic cards, are usually used in computer systems for expansion of resources. The electronic cards are connected to microprocessors of the computer systems via various types of card edge connectors.

An electronic card is conventionally not immediately recognized by an operating system of a computer if it is inserted into a card edge connector of the computer while the computer is running, and the computer needs to be rebooted/restarted in order to utilize information stored in the electronic card. The rebooting/restarting procedure is cumbersome, as is known. Thus, hot plug type electronic cards have been developed in recent years, which are recognized by computers without rebooting/restarting the computer so that they can be inserted into the card edge connectors and initialized while the computer is running.

A hot plug type electronic card requires a hot plug switching mechanism to aid in controlling the electronic card-to-computer interface. Conventional hot plug switching mechanisms are separate from the card edge connectors and are disposed on mother circuit boards to which the card edge connectors are mounted. A hot plug switching mechanism occupying a separate space on the mother circuit board is obviously unfavorable from the standpoint of miniaturization.

Therefore, an electrical card edge connector incorporating a hot plug switching mechanism therein to save space on a mother circuit board is desired.

SUMMARY OF THE INVENTION

A major object of the present invention is to provide an electrical card edge connector which incorporates a hot plug switching mechanism therein to save space on a mother circuit board.

An electrical card edge connector includes an elongated insulative housing, a plurality of engaging terminals mounted in the insulative housing and a pair of switching modules received in the insulative housing.

The insulative housing comprises a card receiving slot for receiving an electronic card therein, a plurality of terminal cavities at two longitudinal sides of the card receiving slot for accommodating the engaging terminals, and a pair of module cavities for receiving the switching modules.

The switching modules each comprise a printed circuit board portion retained in one of the module cavities and a plurality of switching terminals retained by the printed circuit board portion. A plurality of electronic components are attached to the printed circuit board portion, thereby together defining hot plug switching logic circuits therein.

The engaging terminals and the switching terminals are similar in shape and each comprises a contact portion exposed to the card receiving slot. The contact portions of the switching terminals extend relatively higher than the contact portions of the engaging terminals with respect to a slot bottom face of the card receiving slot.

Other objects, advantages and novel features of the invention will become more apparent from the following detailed description of the present embodiment when taken in conjunction with the accompanying drawings.

DETAILED DESCRIPTION OF THE INVENTION

Figure 1:
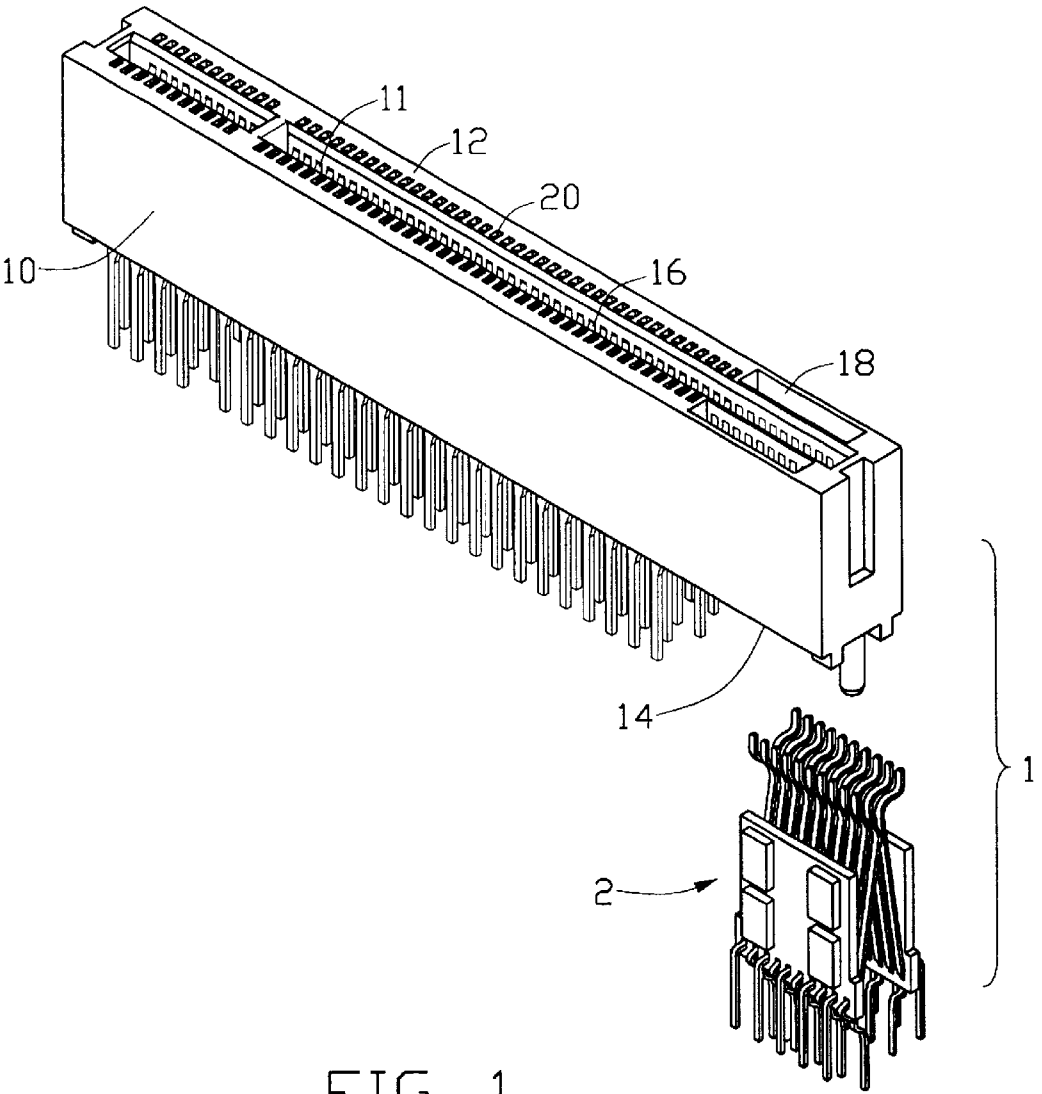
FIG. 1 is a partially exploded view of an electrical card edge connector in accordance with the present invention.
Figure 2:
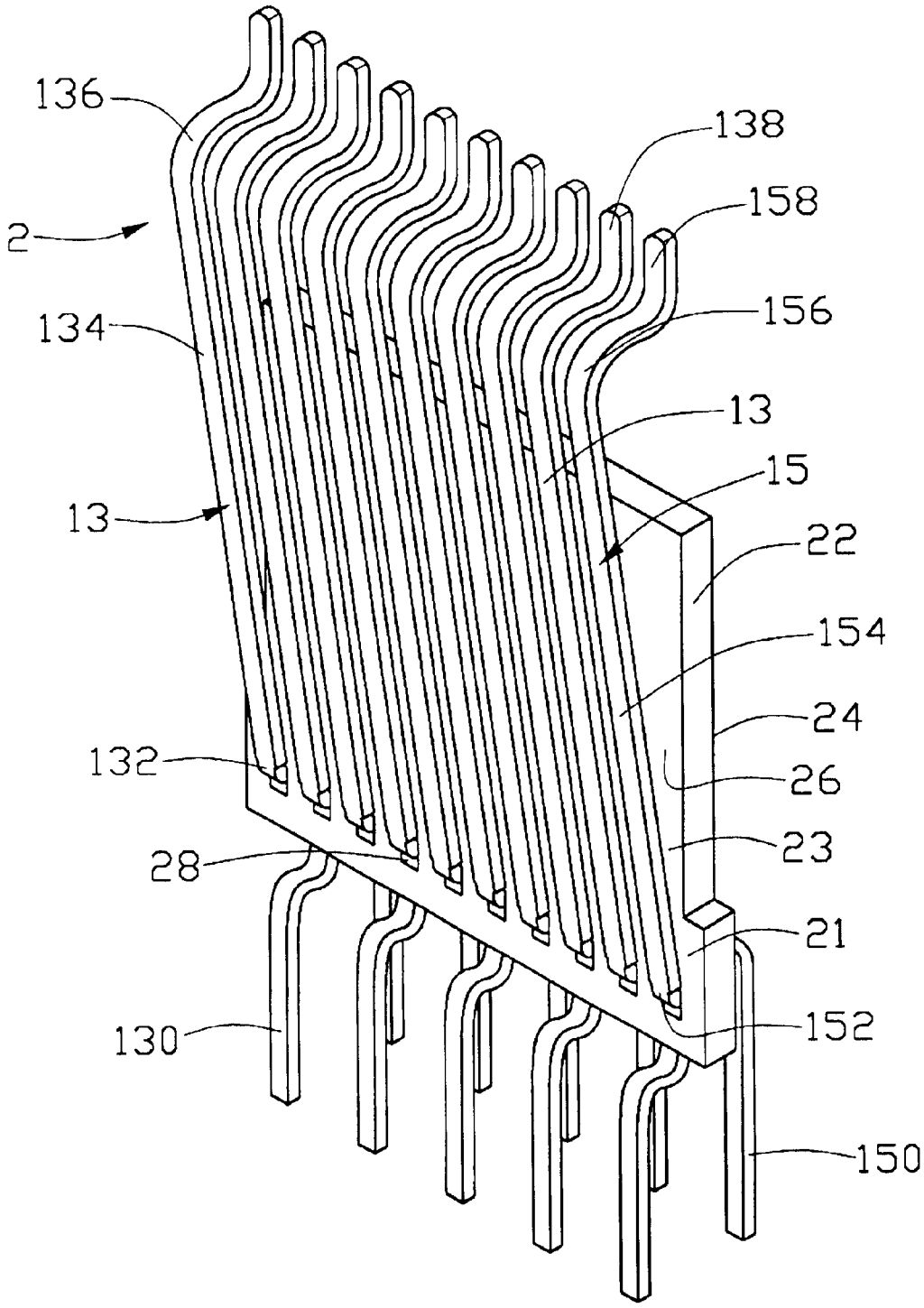
FIG. 2 is an enlarged perspective view of a switching module of the electrical card edge connector of FIG. 1.
Figure 3:
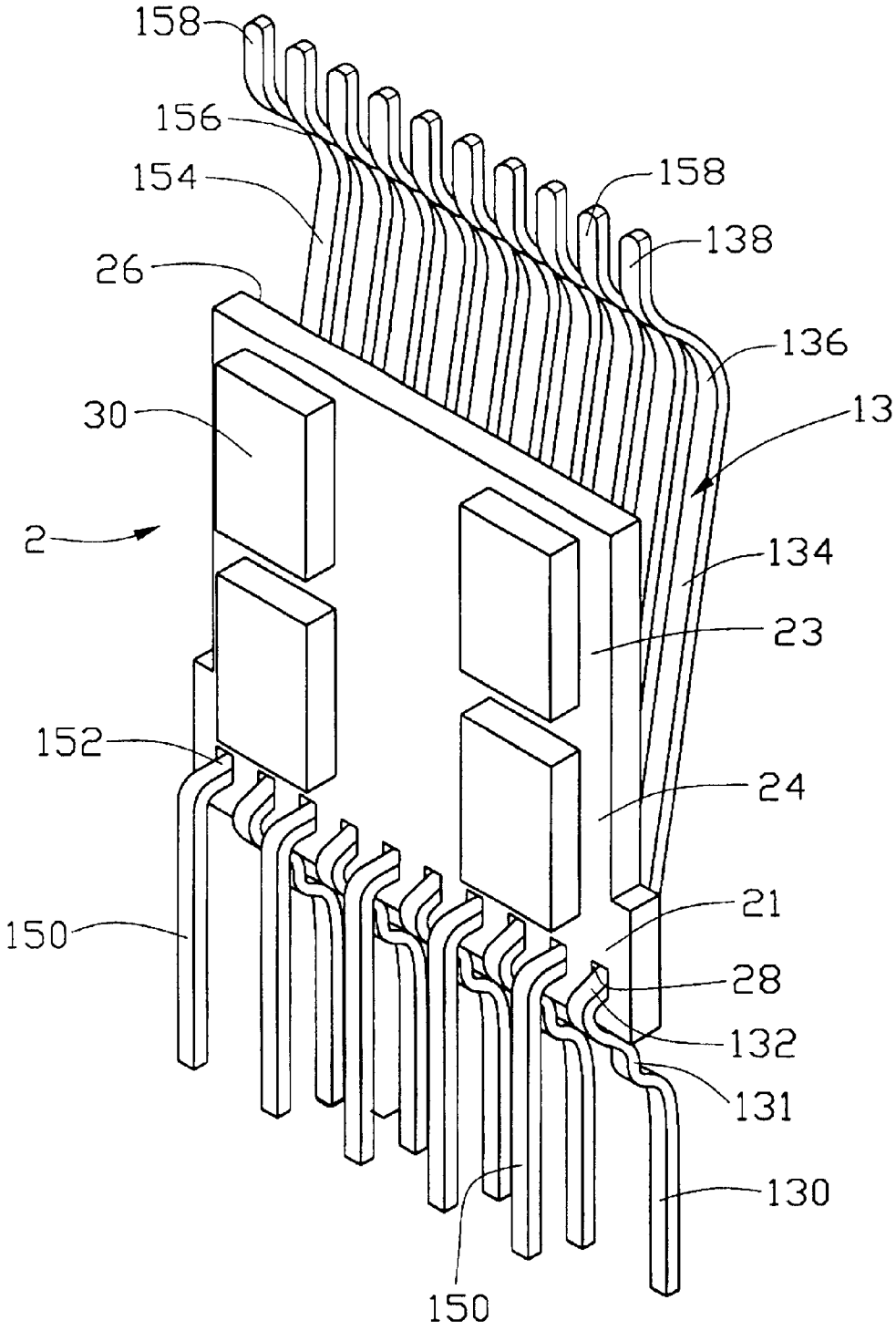
FIG. 3 is similar to FIG. 2 but taken from a different perspective.
Figure 4:
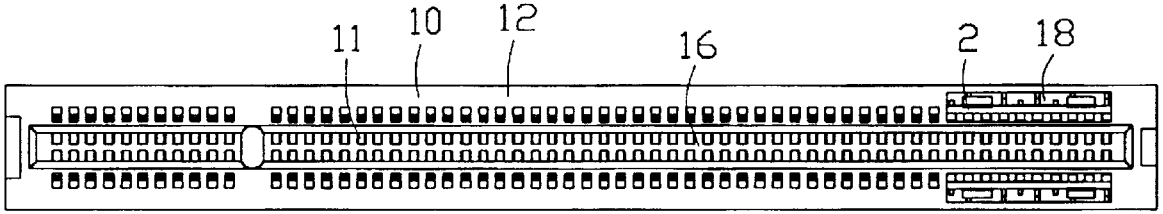
FIG. 4 is a top planar view of the completely assembled electrical card edge connector of FIG. 1.
Figure 5:
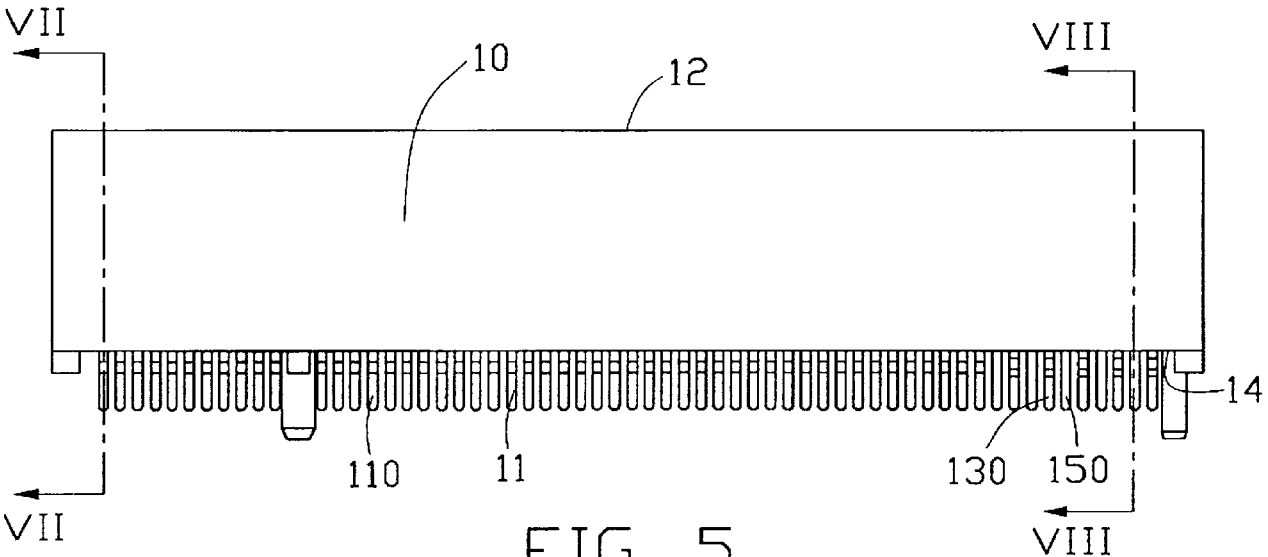
FIG. 5 is a front planar view of FIG. 4.
Figure 6:
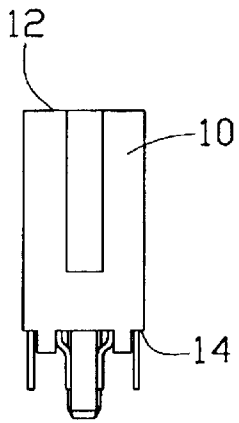
FIG. 6 is a side elevational view of FIG. 4.

Referring to FIG. 1, an electrical card edge connector 1 in accordance with the present invention comprises an elongated insulative housing 10, a plurality of electrical engaging terminals 11 received in the housing 10, and a pair of switching modules 2 received in the housing 10.

Figure 8:
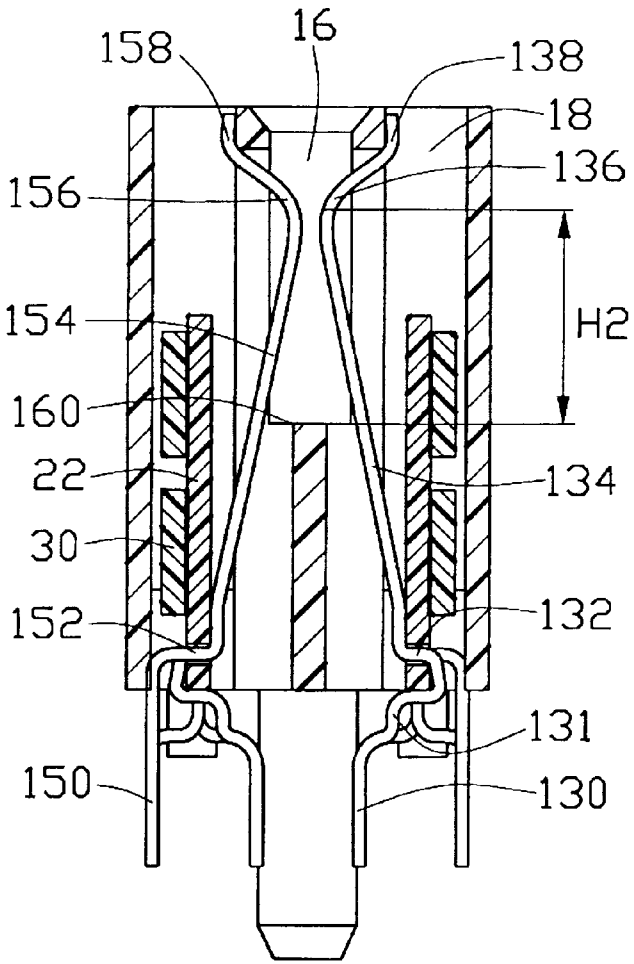
FIG. 8 is a cross section view taken along line VIII—VIII of FIG. 5.

Referring specifically to FIGS. 1 and 4–6, the elongated insulative housing 10 comprises a mating face 12 and a mounting face 14 opposite to the mating face 12. A card receiving slot 16 is defined from the mating face 12 toward the mounting face 14, and terminates at a slot bottom face 160 (FIGS. 7 and 8) that lies substantially at a middle portion between the mating and mounting faces 12, 14. A plurality of juxtaposed terminal cavities 20 and a pair of juxtaposed module cavities 18 are defined in the housing 10 along two longitudinal sides of the card receiving slot 16 and are in communication with the card receiving slot 16.

Figure 7:
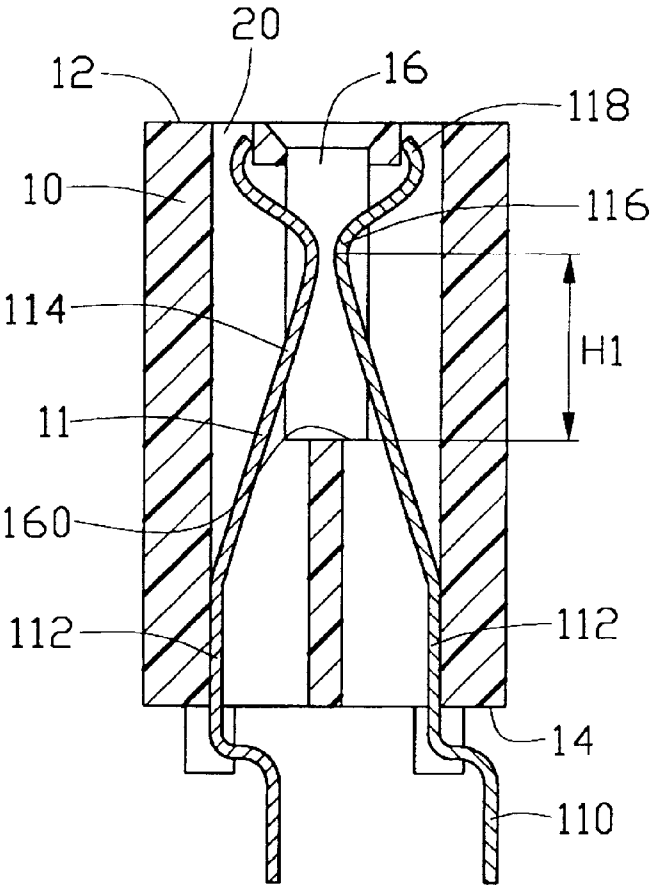
FIG. 7 is a cross sectional view taken along line VII—VII of FIG. 5.

Referring specifically to FIG. 7, each of the electrical engaging terminals 11 comprises a connection portion 110 in the form of a pin for insertion into a contacting hole (not shown) of a mother circuit board (not shown) or the like, a mounting portion 112 having barbs (not shown) for securely retaining the terminals 11 within the insulative housing 10, a spring arm 114, a contact portion 116 in the form of an arcuate contact protrusion, and a free end 118. The mounting portions 112 of the terminals 11 are slightly wider in the longitudinal direction of the housing 10 than the terminal cavities 20.

Referring specifically to FIGS. 1–3 and 7–8, the switching modules 2 each comprise a printed circuit board portion 22 and a plurality of alternately arranged first and second electrical switching terminals 13, 15 retained in the printed circuit board portion 22. The printed circuit board portion 22 defines a first side face 24 and a second side face 26 opposite to the first side face 24. A plurality of electronic components 30 having hot plug switching circuits therein are attached to the first side face 24. The printed circuit board portion 22 further comprises a retention section 21 and a support section 23 having a width relatively smaller than that of the retention section 21. The printed circuit board portion 22 defines a plurality of through holes 28 extending from the first side face 24 to the second side face 26 of the retention section 21.

The first and second electrical switching terminals 13 and 15 are similar in shape to the electrical engaging terminals 11 and each comprises a connection portion 130, 150, a mounting portion 132, 152, aspring arm 134, 154, a contact portion 136, 156, and a free end 138, 158. The number of the switching terminals 13, 15 corresponds to that of the through holes 28 of the printed circuit board portion 22.

In assembly, the electrical engaging terminals 11 are inserted from the mounting face 14 into the terminal cavities 20. The mounting portions 112 provide a secure and stable support of the terminals 11 in the housing 10 because they are relatively larger than the terminal cavities 20. The spring arms 114 partially protrude into the card receiving slot 16, the contact portions 116 are exposed in the card receiving slot 16 and the free ends 118 are still accommodated in the terminal cavities 20. A first distance H1 (FIG. 7) is defined between the contact portions 116 and the slot bottom face 160. The connection portions 110 are arrayed in four rows below the mounting face 14, as conventional.

The first and second alternately arranged switching terminals 13, 15 are assembled to the printed circuit board portion 22. The mounting portions 132, 152 extend through the through holes 28, and are mounted to the printed circuit board portion 22 in plated through hole manner. The spring arms 134, 154 extend slantingly and upwardly beside the second side face 26 from the through holes 28, with the contact portions 136, 156 and the free ends 138, 158 being above the support section 23 of the printed circuit board portion 22. The connection portions 130, 150 of the first and second switching terminals 13, 15 extend downwardly beside the first side face 24. The connection portions 130 of the first switching terminals 13 further have sideward bends 131 under a bottom of the retention section 21 to be biased below and beside the second side face 26, thereby defining two rows of connection portions 130, 150 below the retention section 21. The switching terminals 13, 15 are electrically connected with the electronic components 30.

The assembled switching modules 2 are inserted into the module cavities 18, the retention sections 21 of the printed circuit board portions 22 interferentially engaging with the module cavities 18, thereby retaining the switching modules 2 in the housing 10. The contact portions 136, 156 of the first and second switching terminals 13, 15 are exposed to the card receiving slot 16. The connection portions 130, 150 are aligned with the connection portions 110, all the connection portions 110, 130, 150 thereby being arrayed in four longitudinal rows under the mounting face 14 of the insulative housing 10. There is a second distance H2 between each contact portion 136/156 and the slot bottom face 160, which is a little larger than the first distance H1 between each contact portion 116 of the engaging terminals 11 and the slot bottom face 160.

In use, when an electronic card (not shown) is inserted into the card receiving slot 16, the contact portions 136, 156 of the switching terminals 13, 15 make electrical contact with the electronic card before the contact portions 116 of the engaging terminals 11 due to the relatively larger distance H2 over H1. The switching circuits between the electronic components 30 and the electronic card and power needed by the electronic card to work are thus prepared before full connection of the electronic card with the card edge connector 1.

The electrical connector 1 incorporates the hot plug switching modules 2 therein and saves space on the mother circuit board, while at the same time providing a hot plug convenience for the electronic card.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card edge connector comprising:

an elongated insulative housing defining a mating face, a mounting face opposite to the mating face, a card receiving slot defined from the mating face toward the mounting face and terminating at a slot bottom face in the housing, and a module cavity positioned in the housing in a selected one of two longitudinal sides of the card receiving slot and communicating with the card receiving slot;

a plurality of electrical engaging terminals received in the housing and each defining a contact portion exposed in the card receiving slot, the contact portions of the engaging terminals being spaced from the slot bottom face a first distance; and a switching module received in the module cavity, the switching module comprising a printed circuit board portion retained in the module cavity and a plurality of switching terminals retained in the printed circuit board portion, each switching terminal comprising a contact portion exposed in the card receiving slot, the contact portions of the switching terminals being spaced from the slot bottom face a second distance.

2. The electrical card edge connector as claimed in claim 1, wherein the printed circuit board portion comprises a first side face, a second side face and a plurality of electronic components mounted to one or both of the first and second side faces, circuitry of the electronic components and the printed circuit board portion comprising hot plug switching circuits.

3. The electrical card edge connector as claimed in claim 1, wherein the second distance is relatively larger than the first distance.

4. The electrical card edge connector as claimed in claim 1 further comprises a second switching module and wherein the elongated insulative housing defines a second module cavity in an other of the two longitudinal sides of the card receiving slot to receive the second switching module.

5. The electrical card edge connector as claimed in claim 4, wherein the second module cavity is aligned with the module cavity.

6. The electrical card edge connector as claimed in claim 5, wherein the engaging terminals and the switching terminals each comprise a connection portion extending downwardly beyond the mounting face of the housing, the connection portions of the engaging terminals and the switching terminals being arranged in four longitudinal rows beneath the mounting face.

7. The electrical card edge connector as claimed in claim 1, wherein the printed circuit board portion comprises a retention section engageably received in the module cavity of the insulative housing.

8. The electrical card edge connector as claimed in claim 7, wherein the retention section comprises a number of through holes corresponding to the number of the switching terminals and the switching terminals each comprises a mounting portion extending through and retained by a corresponding through hole of the retention section.

9. The electrical card edge connector as claimed in claim 8, wherein the printed circuit board portion further comprises a support section connected to the retention section and a first and a second side faces, and wherein a plurality of electronic components is mounted to the first side face, and wherein the switching terminals each comprise a spring arm, the contact portion and a free end, which together extend upwardly beside the second side face of the support section.

10. A card edge connector comprising:

an insulative housing having a mounting face adapted for mounting to a printed circuit board, a mating face opposite to the mounting face, a card receiving slot recessed from the mating face, a plurality of terminal cavities and a pair of module cavities beside the card receiving slot;

a plurality of first type terminals received in the terminal cavities and a plurality of second type terminals received in the module cavities, wherein the first type terminals and the second type terminals each having a contact portion adapted for electrically engaging with an electronic card inserted into the card receiving slot, the contact portions of the second type terminals being located nearer to the mating face of the insulative housing than the first type terminals; and a switching module received in the insulative housing and in electrical connection with the second type terminals.

11. A card edge connector comprising:

an insulative housing having a mounting face adapted for mounting to a printed circuit board, a mating face opposite to the mounting face, a card receiving slot recessed from the mating face, a plurality of terminal cavities and at least one module cavity beside the card receiving slot;

a plurality of first terminals received in the terminal cavities and a plurality of second terminals received in the at least one module cavity, the first terminals and the second terminals each having a contact portion adapted for electrically engaging with an electronic card inserted into the card receiving slot; and at least one switching module received in said at least one module cavity and in electrical connection with the second terminals;

the second terminals being further categorized with first and second types thereof alternately arranged along a direction parallel to the card receiving slot, each of the second terminal defining the contact portion, a connection portion and a mounting portion therebetween; wherein the contact portions of all the second terminals are disposed on an inner side of the at least one switching module, while the connection portions of the first type second terminals and those of the second type second terminals are disposed by two sides of the at least one switching module.

12. The connector as claimed in claim 11, wherein the mounting portions of all the second terminals are arranged to extend through the module from the inner side to an outer side of the module.

13. A card edge connector comprising:

an insulative housing defining a card receiving slot;

a module cavity positioned by said card receiving slot;

a switching module received in said module cavity; and a plurality of terminals mechanically and electrically connected to said switching module, each of said terminals defining a contact portion, a connection portion and a mounting portion therebetween; wherein the contact portions of all the terminals are disposed on an inner side of the switching module close to the card receiving slot, the mounting portions of all the terminals extend through said switching module from the inner side to an outer side thereof, and the connection portions of the terminals are alternately disposed on said inner side and said outer side of the switching module.

14. A switching module assembly for use within a card edge connector, comprising:

a printed circuit board with a plurality of electronic components thereon and a plurality of holes therein around a bottom edge thereof;

a plurality of terminals mechanically and electrically connected to said switching module, each of said terminals defining a contact portion, a connection portion and a mounting portion therebetween; wherein the contact portions of all the terminals are disposed on one side of the module, the mounting portions of all the terminals extend through the corresponding holes of said switching module from said side to the other side of the module, and the connection portions of the terminals are alternately disposed on said side and said other side of the module.

* * * * *